US009615635B2

(12) United States Patent
Argiolas

(10) Patent No.: US 9,615,635 B2
(45) Date of Patent: Apr. 11, 2017

(54) WATCHSTRAP, FASTENING SYSTEM FOR A WATCHSTRAP AND CORRESPONDING WATCH

(71) Applicant: PREZIOSI POINT SAGL, Lugano (CH)

(72) Inventor: Silvano Argiolas, Lugano (CH)

(73) Assignee: PREZIOSI POINT SAGL, Lugano (CH)

( * ) Notice: Subject to any disclaimer, the term of this patent is extended or adjusted under 35 U.S.C. 154(b) by 38 days.

(21) Appl. No.: 14/648,879

(22) PCT Filed: Dec. 5, 2012

(86) PCT No.: PCT/IB2012/056978

§ 371 (c)(1),
(2) Date: Jun. 1, 2015

(87) PCT Pub. No.: WO2014/087194

PCT Pub. Date: Jun. 12, 2014

(65) Prior Publication Data

US 2015/0296931 A1 Oct. 22, 2015

(51) Int. Cl.
*A44C 5/20* (2006.01)
*A44C 5/18* (2006.01)
(Continued)

(52) U.S. Cl.
CPC ..... *A44C 5/2071* (2013.01); *A44B 11/266* (2013.01); *A44C 5/185* (2013.01);
(Continued)

(58) Field of Classification Search
CPC ..... Y10T 24/45188; Y10T 24/4567; Y10T 24/4782; Y10T 24/45192; Y10T 24/45262;
(Continued)

(56) References Cited

U.S. PATENT DOCUMENTS 1,498,126 A * 6/1924 Smith ..... A44C 5/2071 224/176
4,318,207 A 3/1982 Stroud
(Continued)

FOREIGN PATENT DOCUMENTS

EP 2 410 887 11/2012
FR 2 593 359 7/1987
(Continued)

OTHER PUBLICATIONS

International Search Report from International Application No. PCT/1B2012/056978 mailed Jul. 19, 2013.
(Continued)

*Primary Examiner* — Robert J Sandy
(74) *Attorney, Agent, or Firm* — Dorsey & Whitney LLP

(57) ABSTRACT

A watchstrap including two separate strap sections, a first section including one or more holes in correspondence to which fastening a second section, to fasten the strap and the watch around a wrist. The strap includes a fastening system with a male part removably fixed to the first section through one of the holes to set a predefined width of the strap, and a female part, fixed on the second section and provided with a receiving seat for snap-engagement of the male part, for an automatic and pre-adjusted fastening of the strap around the wrist, the female part for releasing the male part, to open the strap. Also a fastening system for the strap of a watch and a watch comprising the strap with the corresponding fastening system.

14 Claims, 4 Drawing Sheets

(51) Int. Cl.
*A44B 11/26* (2006.01)
*A44B 17/00* (2006.01)

(52) U.S. Cl.
CPC ..... *A44B 17/0017* (2013.01); *A44D 2201/00* (2013.01); *Y10T 24/45188* (2015.01); *Y10T 24/45194* (2015.01); *Y10T 24/45262* (2015.01); *Y10T 24/4782* (2015.01)

(58) Field of Classification Search
CPC . A44B 11/266; A44B 1/0017; A44B 17/0017; A44C 5/2071; A44D 2201/00
USPC ..... 24/265 WS, 265 WB, 587.11, 587.12
See application file for complete search history.

(56) References Cited

U.S. PATENT DOCUMENTS 5,485,659 A * 1/1996 Kashikie ..... A44C 5/2052 24/265 WS
6,353,977 B1 * 3/2002 Hagmann ..... A44C 5/246 24/265 WS
2008/0005875 A1 * 1/2008 Friedman ..... H04B 1/385 24/578.15
2008/0250612 A1 * 10/2008 Yamamoto ..... A44C 5/2052 24/265 WS

FOREIGN PATENT DOCUMENTS

GB 289 750 5/1928
GB 796 811 6/1958

OTHER PUBLICATIONS

International Preliminary Report on Patentability from International Application No. PCT/IB2012/056978 dated Feb. 24, 2015.

* cited by examiner

WATCHSTRAP, FASTENING SYSTEM FOR A WATCHSTRAP AND CORRESPONDING WATCH

FIELD OF APPLICATION

The present invention relates to a watchstrap with two separate strap sections or segments, which can be fastened one on the other. In particular, the invention relates to a strap for a wrist watch in which a first strap section has one or more holes and the end of a second strap section is fastened in correspondence of a hole, so as to fasten the watch around the wrist.

The present invention also relates to a system for fastening a watchstrap of the type indicated above. The invention also relates to a watch to which the aforementioned strap and fastening system are fitted.

PRIOR ART

As is known, a watchstrap, for example a strap made of leather or hide, has two strap segments or sections, the ends of which can be arranged on top of each other, in order to attach the watch to a wrist, or can be separated, in order to remove the watch from the wrist.

A first section of the strap has a plurality of holes along a central line, at a predefined interval from each other, and a second section of the strap is provided, at an end A thereof, with a buckle and a tongue. An opposite end B of the second strap section may be fixed to the case of a watch, in a manner known per se, as may be one of the ends of the first strap section.

In order to wear the watch after positioning it on the wrist, first the free end of the first strap section is passed through the buckle and then the strap is tightened around the wrist, by pulling the buckle towards the watch case, by means of the first strap section, and finally the strap is fastened by inserting the tongue into one of the holes of the first strap section. The choice of the hole inside which the tongue is inserted allows the strap to be fastened in a more or less loose manner. Once the watch is worn, the free end of the first section is inserted inside a through-band sliding on the second section and having the function of keeping the two sections close to each other.

Such a strap has optimum characteristics in terms of versatility and ease of use, it being simple to adjust its width by inserting the tongue into one of the available holes, without performing any structural adjustments of the strap or the watch itself. This simple adjustment is greatly appreciated because, with time, it may happen that one wishes to wear the watch in a more or less loose manner on the wrist or various persons with different wrist sizes might wish to wear the same watch, without complex adjustment or replacement of the strap being required.

Merely incidentally, it is possible to mention, for example, the metal straps consisting of a plurality of links where adjustment is performed by removing a number of links, said adjustment being much more complicated than in the case of hide or leather straps.

The known strap is greatly appreciated among other things because the two separate sections allow the watch to be attached around the wrist without having to pass it over the hand, something which is instead necessary when putting on a watch with a deployment clasp, this hinge-type fastening system not being liked by persons with a large hand. In fact, the closed straps are formed essentially by a closed ring with an articulated part which allows its cross-section to be varied, increasing it so as to allow the hand to be inserted or removed from the strap, or reducing it, so as to tighten and close the strap around the wrist.

Despite the advantages illustrated above, the two-section strap made of hide or leather has a number of drawbacks.

For example, whenever the watch is put on or removed, the strap must be tightened around the wrist by pulling the buckle by means of the first strap section and this operation may result in an abrasive action on the strap, which in the king run damages the leather, hide or material from which the strap is made.

It also happens that, in the region of the hole where the tongue is inserted, the strap remains folded, owing to the deformation caused when it is passed through the buckle and the fact that it is retained on the second strap section by the through-band for the entire period during which the watch is worn.

The aforementioned deformation also causes structural weakening and alteration of the appearance. Sometimes the form of the tongue remains impressed as a darker zone on the first hide or leather section, creating an undesirable aesthetic effect.

In other cases breakage of the through-band occurs. In still other cases, despite the fact that the first section remains inserted in the strap, its end does not adhere to the second section and gets caught up, for example with clothing, during use.

It is therefore possible that, in the long run, the strap may weaken, break or suffer structural damage thereto, resulting in the worst case in loss of the watch or damage, as a result of it to falling onto the ground.

Finally, adjustment is not always straightforward since in any case it is required to insert the first section inside the buckle and insert the tongue into one of the many holes present on the first section, something which may be difficult in particular conditions of use of the watch, for example when it is dark.

The technical problem forming the basis of the present invention is that of devising a watchstrap which retains the same characteristics of versatility and ease of use of the known strap, but which does not have the drawbacks mentioned above and in particular is not subject to visual or structural damage as a result of the opening and closing operations and which is very simple and safe to use.

SUMMARY OF THE INVENTION

The proposed solution forming the basis of the present invention is that of fitting to one of the holes available on a first section of a strap, for example a strap made of hide, leather, rubber or plastic, a male part or female part of a male/female fastening system, and fitting onto a second separate section of the strap the other, female or male, part of the fastening system.

According to this proposed solution, attachment of the male part or female part to one of the holes of the first section is removable and allows changes of the width of the strap, by fitting the male part or female part to another hole. However, if it is not required to change the width of the strap between successive watch wearing, the strap maintains a preset width, thus avoiding manual adjustment whenever the watch is worn. In fact, the male or female part remains fixed to the hole even after removing the watch from the wrist, allowing substantially automatic, rapid and pre-adjusted fastening of the strap.

Advantageously, according to this proposed solution, the strap no longer requires the tongue and the buckle, and manual adjustment thereof is no longer required whenever the watch is put on, thus preventing any abrasion of the strap caused by rubbing with the buckle or the tongue, or creasing, structural damage or aesthetic damage.

According to this proposed solution, the technical problem described above is solved by a watchstrap comprising two separate strap segments or sections, a first section comprising one or, more holes in correspondence to which an end of a second section is fastened, to fasten the strap and the watch around a wrist, characterized in that it comprises a fastening system with a male part, removably fixed to the first section through one of the holes, to set a predefined width of the strap, and a female part, fixed on the second section and provided with a receiving seat for snap-engagement of the male part, for an automatic and pre-adjusted fastening of the strap around the wrist, the female part including means for releasing the male part, to open the strap.

As already mentioned above, the technical problem may be solved also by a strap in which the male part of a male/female fastening system is fitted to the second section and the female part is fitted to the first section with the holes. In this case also, the strap comprises two separate strap segments or sections, a first section comprising one or more holes in correspondence to which an end of a second section is arranged, so as to fasten the strap and the watch around a wrist, and is characterized in that it comprises a fastening system with a male part, fixed onto the second section and a female part, removably fixed through one of said holes to the first section, so as to set a predefined width of the strap, the female part being provided with a receiving seat for snap-engagement of the male part, for an automatic and pre-adjusted fastening of the strap around the wrist, and including means for releasing the male part, so that the strap may be opened.

More precisely, the description below refers to a preferred embodiment in which the male part is fitted to the first strap section (section with the holes) but it is evident that fitting of the male and female parts onto the strap sections may be reversed, forming a strap which nevertheless falls within the scope of protection of the present application.

Advantageously, with the strap, fastening around the wrist my be speeded up, since the width is already adjusted, and it is merely needed to apply a light pressure onto the male part (on the first strap section) or onto the female part (by means of the second strap section) in order to join together and close the parts, without creasing of the strap or friction against a buckle.

According to one aspect of the invention, the male part comprises a male element and a female element which can be removably joined together, at least one portion between the male element and the female element passes through the holes of the first section and both said male element and female element have a respective head with a cross-section larger than the cross-section of the holes, which prevents the elements from passing through the hole and forms a surface for resting on the first section. In particular, when the parts are joined together, the heads of the male and female elements are on opposite sides of the first strap section.

Advantageously, in order to vary the width of the strap, which is required for example when the watch is worn by another person or because one wishes to loosen it or tighten it around one's wrist, it is sufficient to remove the male element and the female element from the hole to which they are fixed and fit them to another hole on the first strap section.

According to another aspect of the invention, the male part comprises a tip which during use is directed towards the wrist and projects from the first strap section. This tip can be snap-engaged, preferably in a concealed manner, inside the receiving seat of the female part of the fastening system. Advantageously, such a structure simplifies fastening which is achieved by means of a slight pressure on the male part, for example applied on the visible side of the first strap section, which allows the tip to snap engage inside the female part, while the latter is supported and in contact with the wrist.

According to a preferred embodiment, the tip is formed by the head of the male element, while the head of the female element is substantially coplanar with the first section, preferably circular, and visible, during use of the strap on the wrist. The tip is preferably rounded. Essentially, during use of the watch, only the head of the female element, which bears for example a trade name of the watch or the strap, remains visible on the strap, while the tip is received and hidden inside the female seat of the fastening system.

The head of the male element has substantially a mushroom-like form, with a shank of smaller cross-section, preferably passing through the hole in the first strap section, and the tip rounded and larger than the shank. The receiving seat in the female part has an opening with a cross-section substantially equal to a cross-section of the tip of the male element and is associated with a movable plate which, owing to the action of a resilient means (for example a spring), engages at least partly inside the opening. In order to fasten the strap, the rounded tip is first aligned with the receiving seat of the female part and then pressed inside it, so as to move back the plate from the opening of the seat, thus compressing the spring; when the tip has been inserted, the plate moves forward again inside the opening, owing to the thrust of the spring, coming into contact with the shank and locking the tip in the seat. In this way the plate acts as safety device for the fastening system. The plate is structurally associated with release means, which can be operated manually, so as to release the male element, moving the plate back from the seat.

According to the proposed solution illustrated above, the possible systems for mechanically joining together the male part and female part, as well as the systems for mechanically joining together the male element and female element, may also be varied. For example, in one embodiment, the male element and the female element consist of a screw and a female thread which can be screwed into one another, preferably along a section thereof which involves the holes in the first section and its entire thickness.

Preferably, the male part and the female part of the fastening system are made of metallic material or an alloy. The first and second strap sections are made of hide or leather or flexible material, for example rubber, plastic or polymer material.

According to another aspect of the present invention, the female part forms a terminal part of the second strap section, at the end thereof to which it is fixed.

The aforementioned problems are also solved by a fastening system for a watchstrap, characterized in that it comprises a male part and a female part. In particular, either one of the male part and female part is removably fixed through a hole in a first section of the strap provided with a plurality of holes for setting a predefined width of the strap, and the other one of the male part and female part is fixed onto a second and separate section of the strap. The female part has a receiving seat for snap-engagement of the male part, for automatic and pre-adjusted fastening of the strap around the wrist, and comprises means for releasing the male part, to open the strap.

The watchstrap, the fastening system and the corresponding watch according to the present invention are described hereinbelow by way of a non-limiting example with reference to the accompanying drawings.

DETAILED DESCRIPTION

Figure 1:
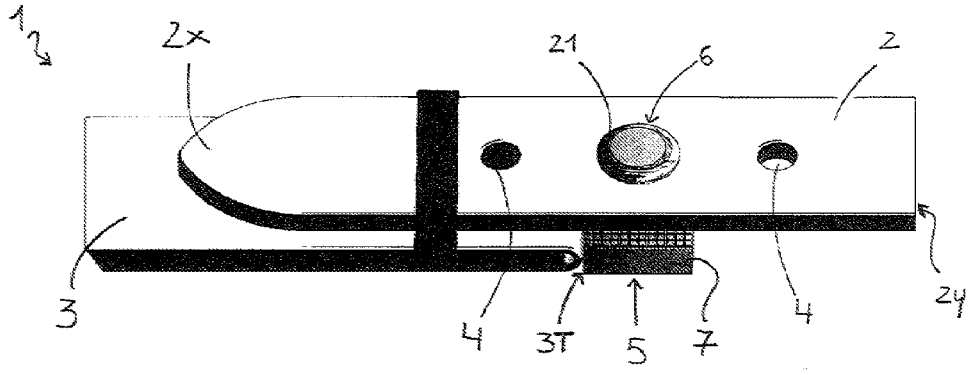
FIG. 1 is a perspective view of the strap according to the present invention.

With reference to the accompanying drawings, the reference number 1 schematically denotes a watchstrap, in particular a watchstrap for a wrist watch, of the type comprising two different strap segments or sections 2, 3, each of which is designed to be fixed at one of its end to a watch structure, by means of fixing means.

These means consist for example of a pin which is inserted inside a slit formed at the end of the section 2, 3, for example formed by means of folding over of the section onto itself; the pin has two opposite ends which emerge from the strap section and are fixed between two seats formed in the watch case.

The strap is for example made of hide or leather, but may also be made of plastic or rubber, as will become clear from the description below.

A first strap section 2 has one or more holes 4 which are formed in the thickness of the strap and in correspondence to which the end of a second section 3 is fastened, to fix the strap and the watch around a wrist. Preferably, the holes 4 are not formed along the entire length of the strap; for example, a first hole 4 is near the end 2*x* of the first section 2 opposite to the end 2*y* where the section 2 is fixed to the watch structure; the holes have a predefined interval which allows the strap to be adjusted between a maximum width, obtained by aligning the end of the second section with the first hole 4, and a minimum width, obtained by aligning the end of the second section with the last of the holes 4.

Figure 2:
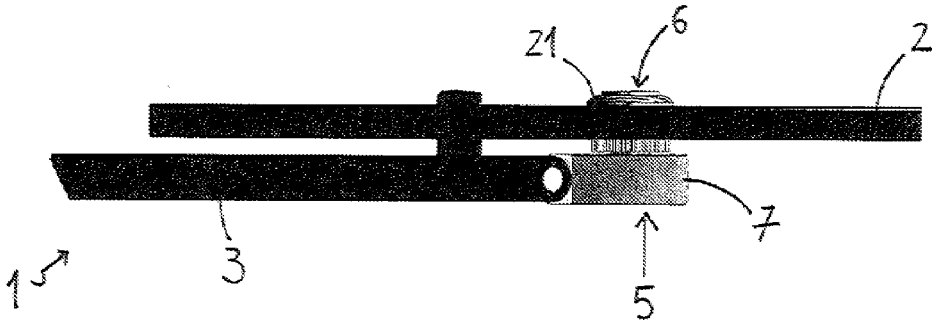
FIG. 2 is a side view of the strap according to FIG. 1.

According to the present invention, a fastening system 5 for the strap comprises a male part 6, which is removably fixed to the first section 2 via one of the holes 4, and a female part 7, which is fixed to the second section 3, so as to receive the male part and fasten together the two sections in a predefined width of the strap. FIGS. 1 and 2 show the male part and female part during fastening of the strap.

Advantageously, once the user has defined, from among the plurality of holes available, the hole 4 which corresponds to the preferred width of the strap, the male part is fixed once only to the hole 4, thus setting a width which is maintained between successive strap opening and closing operations. The male part, however, may be removed and the width may therefore be varied if required, for example if the user wishes to widen the strap, following slight variations in the size of the wrist, or if a different user intends wearing the watch or immediately after purchase.

Moreover, closing and opening are performed avoiding any structural stress affecting the strap, by moving the two sections towards each other and joining the male part together with the female part, without folding the sections or causing them to rub together, thus avoiding-structural weakening of the strap.

Figure 3:
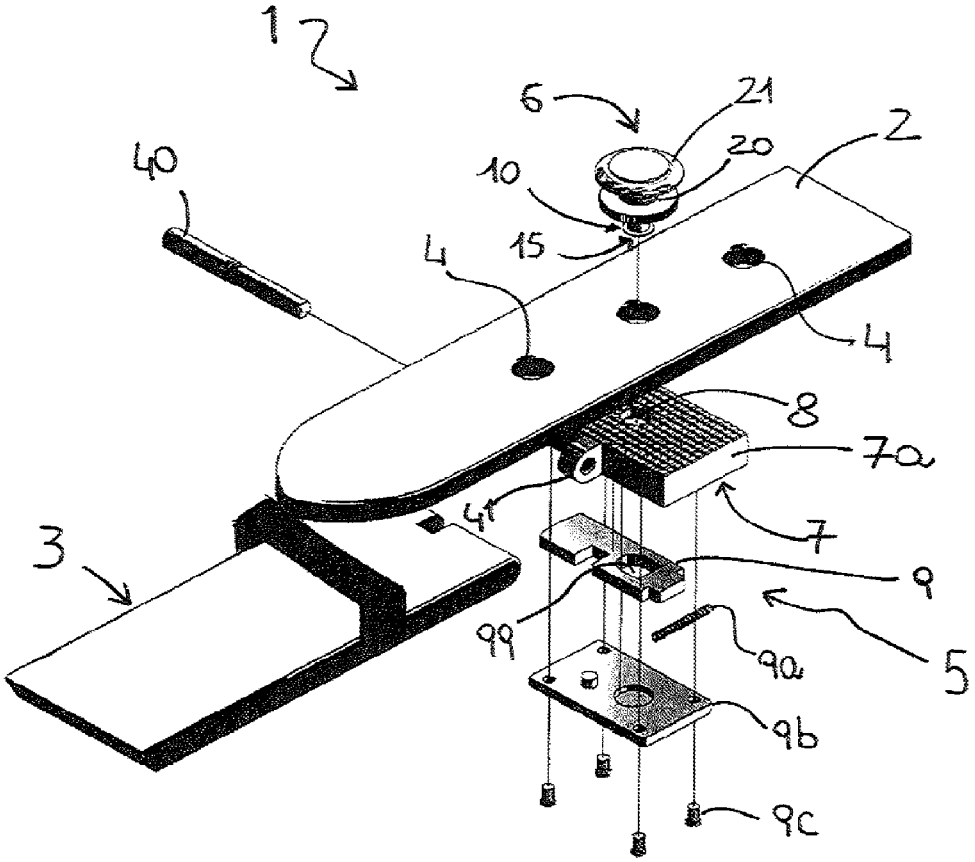
FIG. 3 is an exploded perspective view of the strap according to the present invention, in an embodiment thereof.

In particular, with reference to FIG. 3, the female part 7 is provided with a receiving seat 8 for snap-engagement of the male part 6, for automatic fastening, and comprises release means 9 for the male part 6, for opening of the strap. This figure shows a non-limiting example of embodiment of the fastening system 5, in which the receiving seat 8 for the male part is formed in a structural block 7*a* of the female part 7 and is associated with a lever 9.

The lever 9 is provided with a hole 99 and is kept by means of resilient means in a position partially interfering with the passing movement of the male part 6 inside the receiving seat 8, for example by means of a spring 9*a*. The lever 9 is movable and accessible on the outside of female part, so as to centre the hole 99 with respect to the receiving seat 8, allowing the male part 6 to be received inside the receiving seat 8.

In particular, in order to fasten the system 5, a tip 15 of the male part is aligned inside the receiving seat 8 and a light pressure is applied onto the male part 6 in order to displace the lever 9 by means of the tip 15, overcoming the resilient means and causing the lever 9 to move backwards, thus centring the hole 99 with the receiving seat 9 and allowing the male part 6 to enter into the receiving seat 8 in a predefined manner. Once insertion has been performed, the lever 9 returns automatically into the position where it partially interferes owing to the action of the resilient means, and prevents the male part 6 from coming out of the receiving seat 8, retaining the tip 15 thereof.

For example the tip 15 has a substantially conical, preferably rounded, cross-section, and the male part has a shank with a smaller cross-section than a larger base of the tip 15; when retracted into the partly interfering position, the plate 9 engages with the base of the conical tip 15 and prevents the male part 6 from coming out.

Figure 6:
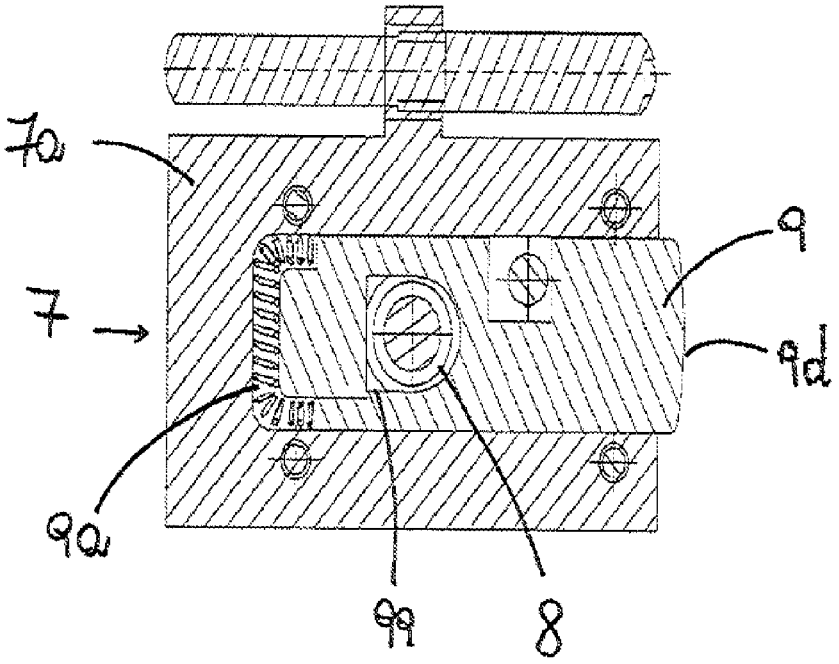
FIG. 6 is another perpendicularly sectioned view of the system according to FIG. 5.
Figure 7:
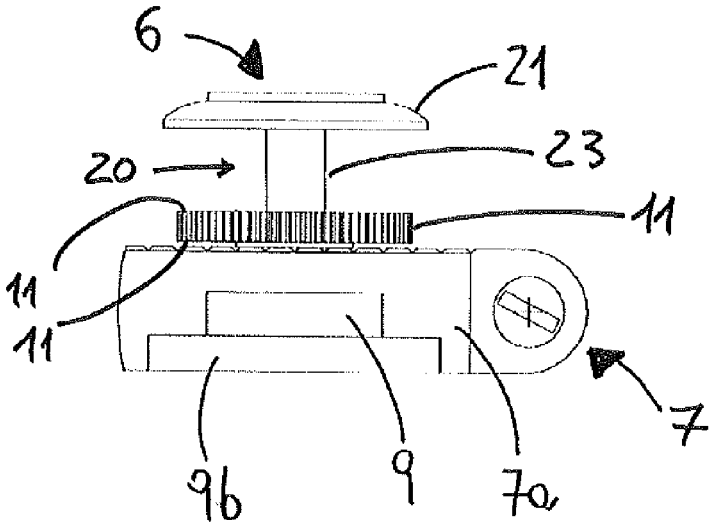
FIG. 7 is a front, enlarged and partial view of the system according to FIG. 5.

In order to open the strap, a lug 9*d*, which is accessible on the outside of the female part 7, allows a pressure to be applied onto the lever 9, which overcomes the force of the resilient means, centring the hole 99 with the receiving seat 8, and therefore allowing extraction of the male part from the female part. The above description can also be understood with reference to FIGS. 5-7, where the fastening system 5 is shown with the male part and female part joined together.

According to another aspect of the present invention, the male part 6 and the female part 7 are made of metallic material or an alloy. Advantageously, the structural stresses of such a fastening system 5 affect only the male part and the female part and not the strap.

According to another aspect of the present invention, the male part 6 comprises a male element 10 and a female element 20 which can be removably joined together, at least one of the male element and female element has a portion, also called shank, which passes through the holes 4, so as to fix the male part 6 to the first strap section, and both the male element and female element have a respective head 11, 21 with a cross-section greater than the cross-section of the holes 4, in order to prevent the male part from coming out of the holes of the first section. When the parts are assembled, the heads 11, 21 are on opposite sides 2A, 2B of the first strap section 2.

Figure 4:
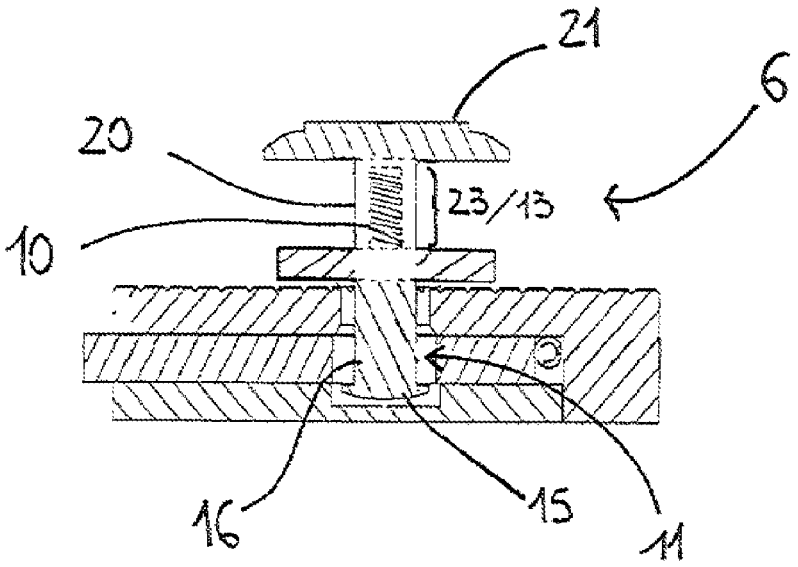
FIG. 4 is a side view of a male part of a strap fastening system according to the present invention, in one of its possible embodiments.

With reference to FIG. 4, this shows an embodiment of the male part 6, in which the female element 20 has a head 21 and a female thread 23, and the male element 10 has a head 11 and a screw 13. The female thread 23 has a length and a diameter substantially corresponding to a thickness and a diameter of the holes 4 in the strap, for example 2 mm thickness and diameter, and can be inserted inside the hole 4, so as to occupy it completely, the head 21 resting on one side of the first strap section.

The screw 13 of the male element is screwed into the female thread 23 of the female element until the head 11 of the male element is arranged against an opposite side of the first section, substantially gripping the strap between the heads 11 and 21.

Figure 5:
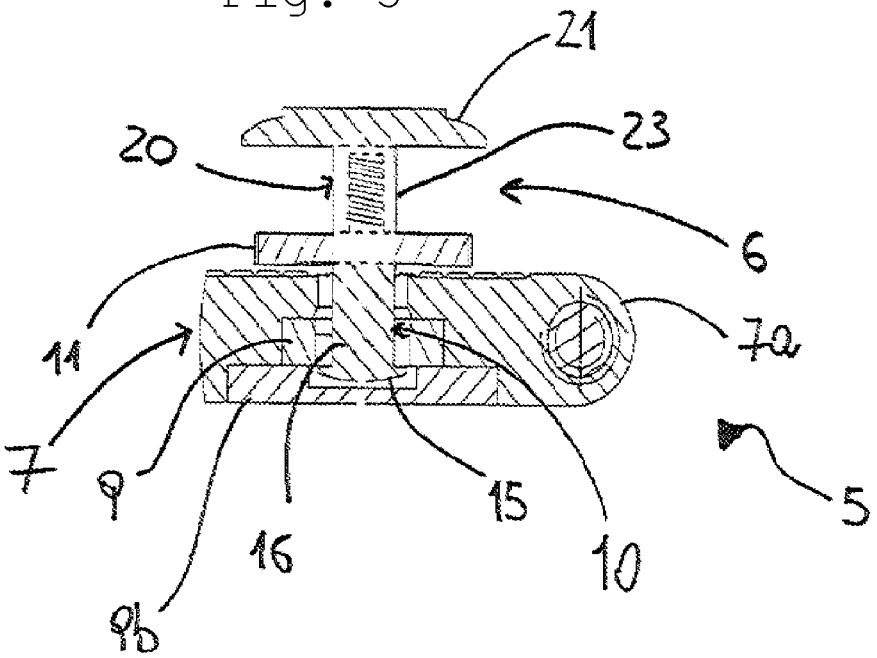
FIG. 5 is a laterally sectioned view of the strap fastening system according to the present invention, in one of its possible embodiments.

FIG. 5 shows in schematic form the male part 6 and the female part 7 during fastening. In this figure, the screw 13 of the male element 10 is not visible because it is engaged inside the female thread 23 of the female element 20; the strap is not shown and is intended to occupy the space between the heads 11 and 21.

According to another embodiment, it is envisaged that only one of the male element 10 and the female element 20 (and hence only one shank) passes through the hole 4 and that the male element is screwed into the female element in a threaded portion of the latter defined in its head 21. This embodiment is advantageous for straps which are very thin or have holes 4 with a small diameter inside which it would be more difficult to fit two elements (male element and female element) rather than a single element.

According to other embodiments, the system for joining together the male element and the female element is not of the screw/female thread type but is a different type of mechanical joining system which substantially comprises a shaft as a male element and a hole as a female element.

The tip of the male part, for example the tip 15 in FIG. 4, is directed during use towards the wrist, projects from the first strap section and can be snap-engaged, preferably in a hidden way, inside the receiving seat 8 of the female part 7 of the fastening system 5. The tip 15 is preferably formed on the head 11 of the male element 10.

Apart from the tip 15, the remaining portion of the head 11 is arranged against and substantially coplanar with the first section 2, being preferably circular, and not visible, when the strap is worn on the wrist, since it faces the wrist. The tip 15 of the male element has a mushroom-like form, with the terminal part having a larger cross-section, designed to locate against the release means 9 of the female part inside the receiving seat 8, and the shank 16 having a smaller cross-section. The head 21 of the female element is also arranged against and substantially coplanar with the first section 2, being preferably circular, but visible, when the strap is worn on the wrist, since it is arranged on the opposite side of the first section 2 with respect to the head 11 of the male element 10.

According to another aspect of the invention, the female part 7 forms a terminal part 3T of the second section 3 of the strap. As can be seen in FIG. 3, a pin 40 can be inserted through a slit of the terminal part 3T, for example formed by means of folding back thereof, passing through a ring 41 of the female part 7.

Many variations of embodiment are possible according to the proposed solution forming the basis of the present invention. For example, it is envisaged that the female element, and not the male element, may incorporate or form the tip 15 which can be inserted in the female part 7 of the fastening system.

It is also envisaged that the female part 7 may be associated with the first section 2 (the section with the holes) and the male part 6 may be associated with the second section. In particular, according to this embodiment, it is envisaged that a strap may still comprise two separate strap sections 2, 3, a first section 2 comprising one or more holes 4 opposite which the end of a second section 3 may be fastened, in order to fasten the strap and the watch around a wrist. The fastening system 5 has a male part, fixed onto the second section, and a female part, removably fixed through one of said holes 4 to the first section 2, so as to set a predefined width of the strap, and provided with a receiving seat 8 for snap-engagement of the male part, for automatic and pre-adjusted fastening of the strap around the wrist, said female part including means 9 for releasing the male part, so that the strap may be opened.

According to this embodiment, the female part comprises a male element and female element which can be removably joined together, at least one of them passing through the holes 4 and both comprising a respective head with a larger cross-section than the holes 4, so as to prevent the female part from coming out of the of the hole in the first section. Also according to this embodiment, the heads are on opposite sides 2A, 2B of the first strap section 2, which is gripped between them.

The technical problem forming the basis of the present invention is also solved by a fastening system 5 for a watchstrap. For example, with reference to FIG. 8, the system comprises a male part 6 and a female part 7, either one of the male part and female part being designed to be removably fixed through a hole 4 of a first strap section, the other one of the male part 6 and female part 7 being designed to be fixed onto a second separate section 3 of the strap. The female part is provided with a receiving seat 8 for snap-engagement of the male, part 6, for automatic and pre-adjusted fastening of the strap around the wrist, and includes means 9 for releasing the male part 6, so that the strap may be opened.

A watch according to the present invention, namely characterized in that it comprises a strap and a fastening system of the type described above, has significant advantages. It is simple and quick to put on, since the system for joining the male part to the female part is automatic. It has a strap which maintains a perfect appearance and remains always structurally intact, as well having a safe action, since opening and closing do not require folding or pulling of the strap, but only joining of the male part to the female part. Moreover, the adjustment defined by the user when the male part is fitted to the hole is maintained for the following strap opening and closing operations.

The invention claimed is:

1. A watchstrap, comprising:

two separate strap sections including a first section and a second section, the first section including one or more holes in correspondence to which the second section is configured to be fastened in order to fasten the watchstrap and associated watch around a wrist; and a fastening system including:

a male part removably fixed to the first section through one of the one or more holes for setting a predefined width of the watchstrap; and a female part fixed on the second section, the female part provided with a receiving seat for snap-engagement of the male part and for an automatic and pre-adjusted fastening of the watchstrap around the wrist, the female part including means for releasing the male part to open the watchstrap;

wherein the female part forms a terminal part of the second section and includes a ring;

wherein the female part is fixed on the second section by a pin inserted through both a slit of the terminal part and the ring.

2. The watchstrap according to claim 1, wherein the male part includes a male element and a female element removably joined together, at least one of the male or female elements including a shank insertable through the one or more holes and both of the male and female elements including a respective head with a larger cross-section than a section of the one or more holes, the heads arranged on generally opposite sides of the first strap section.

3. The watchstrap according to claim 2, wherein the male part includes a tip that during use is directed towards the wrist and projects from the first strap section, the tip being snap-engageable and hidden inside the receiving seat of the female part of the fastening system and being formed on the head of the male element.

4. The watchstrap according to claim 2, wherein the male element and the female element are screwed, along a section involving the one or more holes and an entire thickness of the first strap section.

5. The watchstrap according to claim 2, wherein the head of the female element is arranged against and substantially coplanar with the first section, and the head is also visible during use of the watchstrap on the wrist.

6. The watchstrap according to claim 2, wherein the head is circular.

7. The watchstrap according to claim 2, wherein the head of the male element has a mushroom-like form.

8. The watchstrap according to claim 1, wherein the male part and the female part are formed from a metal material or an alloy.

9. The watchstrap according to claim 1, wherein each of the first section and the second section is made of hide, leather, plastic, or rubber.

10. A watch comprising the watchstrap according to claim 1.

11. A watchstrap, comprising:

two separate strap sections including a first section and a second section, the first section including one or more holes in correspondence to which the second section is configured to be fastened in order to fasten the watchstrap and associated watch around a wrist; and a fastening system including:

a male part fixed onto the second section; and a female part removably fixed to the first section through one of the one or more holes to set a predefined width of the watchstrap, the female part provided with a receiving seat for snap-engagement of the male part and for automatic and pre-adjusted fastening of the watchstrap around the wrist, the female part including means for releasing the male part to open the watchstrap;

wherein the male part forms a terminal part of the second section and includes a ring;

wherein the male part is fixed to the second section by a pin inserted through both a slit of the terminal part and the ring.

12. The watchstrap according to claim 11, wherein the female part includes a male element and a female element removably joined together, at least one of the male or female elements including a shank passing through the one or more holes and both of the male and female elements including a respective head having a cross-section greater than a cross-section of the one or more holes, the heads arranged on generally opposite sides of the first strap section.

13. A fastening system for a watchstrap, the fastening system comprising:

a male part; and a female part;

wherein one of the male part or female part is removably fixed through a hole in a first section of the watchstrap, the first section including a plurality of holes for setting a predefined width of the watchstrap, and the other one of the male part or the female part fixed onto a second and separate section of the watchstrap and provided with a receiving seat for snap-engagement of the male part for an automatic and pre-adjusted fastening of the watchstrap around a wrist, the female part including means for releasing the male part to open the watchstrap;

wherein the female part is configured to form a terminal part of the second section and comprises a ring and in that the female part is adapted to be fixed on the second section by means of a pin inserted through both a slit of the terminal part and the ring.

14. A watch comprising the fastening system according to claim 13.

* * * * *